US009144843B2

(12) United States Patent
Lessmann et al.

(10) Patent No.: US 9,144,843 B2
(45) Date of Patent: Sep. 29, 2015

(54) DUST EMISSION REDUCTION DURING METAL CASTING

(71) Applicant: PAUL WURTH S.A., Luxembourg (LU)

(72) Inventors: Hans Juergen Lessmann, Trier (DE); Ingo Both, Schweich (DE); Michel Houbart, Amay (BE); Klaus Peter Kinzel, Minas Gerais (BR); Gilles Nouaille-Degorce, Luxembourg (LU)

(73) Assignee: PAUL WURTH S.A., Luxembourg (LU)

( * ) Notice: Subject to any disclaimer, the term of this patent is extended or adjusted under 35 U.S.C. 154(b) by 0 days.

(21) Appl. No.: 14/348,157

(22) PCT Filed: Sep. 27, 2012

(86) PCT No.: PCT/EP2012/069127
§ 371 (c)(1),
(2) Date: Mar. 28, 2014

(87) PCT Pub. No.: WO2013/045577
PCT Pub. Date: Apr. 4, 2013

(65) Prior Publication Data

US 2014/0331515 A1 Nov. 13, 2014

(30) Foreign Application Priority Data

Sep. 28, 2011 (LU) ..... 91880

(51) Int. Cl.
*B22D 45/00* (2006.01)
*B22D 5/04* (2006.01)

(52) U.S. Cl.
CPC ..... *B22D 45/005* (2013.01); *B22D 5/04* (2013.01)

(58) Field of Classification Search
CPC ..... B22D 5/04; B22D 45/005
USPC ..... 164/130, 322, 323, 324, 329, 412
See application file for complete search history.

(56) References Cited

U.S. PATENT DOCUMENTS 3,044,868 A * 7/1962 Francis ..... 75/413
4,605,055 A 8/1986 Allen, Jr.

(Continued)

FOREIGN PATENT DOCUMENTS

| | | |
|---|---|---|
| CN | 201744652 U | 2/2011 |
| FR | 1302669 | 8/1962 |
| JP | 54056027 A | 5/1979 |
| JP | 4052050 A | 2/1992 |

OTHER PUBLICATIONS

International Preliminary Report on Patentability or corresponding application PCT/EP2012/069127 filed Sep. 27, 2012; Mail date Feb. 16, 2013.

(Continued)

*Primary Examiner* — Kevin P Kerns
(74) *Attorney, Agent, or Firm* — Cantor Colburn LLP

(57) ABSTRACT

Dust emissions can be reduced in a metal or slag casting apparatus by providing an endless conveyor having a plurality of casting molds with upper open tops wherein the conveyor is arranged to move the casting molds in a first section from a casting station to a discharge station and in a second section back to the casting station. The method for reducing dust emissions includes (a) providing a casing forming a bottomless box over at least part of the first section of the conveyor, (b) injecting within the casing a gas on the surface of the mold with an angle configured to blow off loose, solid particles, formed at the surface of the metal, during early stages of the cooling down and to start the solidification of a superficial layer of metal or slag, and (c) extracting the gas and the solid particles by suction from within the casing.

20 Claims, 2 Drawing Sheets

(56) References Cited

U.S. PATENT DOCUMENTS 4,615,511 A * 10/1986 Sherwood ..... 266/208
6,390,174 B1 * 5/2002 Bloch et al. ..... 164/131

OTHER PUBLICATIONS

International Search Report for corresponding application PCT/EP2012/069127 filed Sep. 27, 2012; Mail date Jan. 15, 2013.

* cited by examiner

DUST EMISSION REDUCTION DURING METAL CASTING

TECHNICAL FIELD

The present invention generally relates to reducing dust emission during hot metal or slag casting, in particular in metal casting machines and especially during pig (iron) casting.

BACKGROUND ART

As it is well known within the art, liquid hot metal is either poured directly out of the bottom of the blast furnace through a trough into a ladle car for transfer to the steel mill. If it cannot be processed directly, it is cast in the form of ingots, so-called pigs, for storage or for further transport.

Nowadays, so-called pig casting machines or apparatuses are used for manufacturing said pigs of pig iron. They conventionally comprise a casting station, at least one endless conveyor with a plurality of casting molds, as well as a removal station at the discharge point of the endless conveyor.

When reaching the casting station, the (empty) casting mould is filled with liquid hot metal and is conveyed to the discharge point. The conveying path and/or conveying time of the metal within the casting machine must be chosen such that the liquid metal in the respective pig casting mould is essentially solidified before reaching the discharge point. In order to accelerate the solidification process of the liquid hot metal and to thereby reduce the required length of the conveyor, the pig casting machines generally further comprise an active cooling zone at some distance of the casting station and before the discharge point. In this active cooling zone, the casting molds and/or the metal inside are generally cooled with water, either from the sides or beneath the molds or from above, or using any combination thereof. Examples of casting machines with active water cooling zone(s) are described e.g. in U.S. Pat. No. 4,605,055, in JP 4 052050 or in FR 1 302 669. When passing through the discharge point, the casting molds either automatically empty by tilting over an inversion point or the pigs are removed by means of a corresponding device.

During the slow solidification of a Fe-C alloy containing more than 4.3% C (i.e. a hypereutectic composition), such as pig iron, part of the carbon is pushed out of the liquid matrix and forms light, flyable particles named "graphite kish" or "carbon flakes" on the surface of the solidifying metal. This is especially true while casting metal out of a blast furnace (C=4.3%-5.1%). Because of their light weight, these graphite particles can fly everywhere, in and around, the workshop and can be a concern in term of industrial hygiene and environmental protection.

Furthermore, the graphite particles still remaining on the surface of the pigs when entering the active cooling zone in the upper part of (a first section of) the conveyor are lifted off by the steam formed when the cooling water comes in contact with the hot metal which leads to a further dissemination of the graphite particles around the plant.

At least, in theory, the phenomenon of flaking out can be avoided if the solidification speed is sufficient enough to freeze the liquid composition in its initial state. In practice however, this is rarely possible due to the size of the pigs.

Although graphite kish formation is a particular issue during pig iron casting, the dust formation during casting of other metals or slags may also be a concern. The dusts in all these cases may take their origin in the smelting of the metal itself, in the pouring of the molten metal in the casting station or during reaction with the ambient atmosphere, such as slag and dross residues, fine solidified particles of metal and metal oxides, etc.

BRIEF SUMMARY

The invention provides a method and a device to reduce diffuse dust emissions during the casting of a metal or slag and in particular, but not exclusively, in integrated steel plants. It is a further object of the invention to propose a solution which is implementable in known metal casting apparatuses without requiring complex and expensive modifications to this well-proven and established techniques.

In order to overcome the above-mentioned problem, the present invention proposes, in a first aspect, a method for reducing dust emissions during the casting of a molten metal or slag in the form of ingots with an apparatus comprising an endless conveyor having a plurality of casting molds with upper open tops and which endless conveyor is arranged to move said casting molds in a first section from a casting station to a discharge station and in a second section back to the casting station. In fact, the method comprises the following steps:

(a) providing a casing forming essentially a bottomless box over at least part of the first section of the endless conveyor, preferably over a part of the first section located adjacent to the casting station (also called lower region of the conveyor), the casing preferably having a length in the conveying direction which represents 0.05 to 0.75, even more preferably between 0.1 and 0.5 times the length of the first section of the endless conveyor; such as at a position adjacent to the casting station and extending to about half the length, more preferably to about the third or less of the length of the first section of the endless conveyor, (b) injecting within said casing a gas with an angle $\alpha$ sufficient to blow out fine, solid particles formed at the surface of the metal or slag during the early stage of cooling down and to start the solidification of an upper layer of the metal or slag ingot; this angle $\alpha$ being preferentially in the range of 2 to 40°, preferably 3 to 30°, with respect to an upper surface of the ingots, resp. to the upper open tops of casting molds containing the molten metal or slag, to blow of loose solid particles from the exposed upper surface of the molten metal or slag and to concomitantly obtain a superficially solidified metal;

(c) extracting the gas and the solid particles by suction from within said casing.

In fact, the main benefit of the present method is of course the significant reduction in emissions and thus is of particular interest in terms of industrial safety, health and environment. This benefit principally results from the following double effect: first, any loose particles located on or being formed on the surface of the metal while still molten may be easily blown away and captured through the suction opening, and second, the blowing of gas promotes a rapid superficial solidification of the metal, acting as a rapid sealing of the otherwise still molten metal.

In fact, the superficial solidification and sealing induced by the method described herein is generally itself advantageous in that it reduces exchanges between the metal and the atmosphere, such as the flaking out of graphite in cast pig iron, it slows down or confines oxidation reactions to the surface of the metal, it prevents surface deterioration if active water cooling from above the casting molds is used thereafter (see below), etc.

Indeed the injection of a gas with appropriate intensity and a relatively shallow angle to the surface of the molten metal also combines good loose particle blowing off performance and low impact on the surface of the molten metal. As a consequence, the surface of the metal "freezes" to form a solid skin without noticeable decline in surface quality (i.e. no impact holes, etc.). The intensity (or speed) of the gas injection mainly depends on the type (nature, density, shape, etc.) of the particles and can be easily determined by the skilled person.

But these are not the only advantages. As a matter of fact, the method above can be implemented relatively easily and economically, even on existing metal casting apparatuses and does not require important, if any, modifications, neither to the equipments, nor to the operation thereof.

Hence, the above method allows taking out dust or graphite particles at the source (and before adding any water) and it largely prevents further undesirable reactions at the metal surface, such as graphite flake-out, etc.

It is to be noted that in the context of the invention, it is clear that the term "metal" also refers to alloys and particularly metal and alloys comprising further components, even non-metallic species. The term "slag" as used herein refers to any oxides mixtures.

Furthermore, the expression "bottomless box" refers to a box-like structure, which is such that there is essentially no bottom wall part of the casing over the endless conveyor. This does not exclude the bottomless box from comprising a closing bottom part below the endless conveyor.

The extracted dust particles are preferably thereafter separated from the gas. This can be done by any appropriate means. Hence, in a further embodiment, the above method further comprises the step of (d) separating the solid particles from the gas, preferably using bag filters, electrostatic filters, cyclones, scrubbers, etc.

The separation allows for the recovering of the dust particles. Depending on the nature and the value of the dust particles extracted from the metal casting process, different techniques might be envisaged to effect this operation. For example, if the dust particles mainly comprise in graphite kish, bag filters may be used. However, if the composition is more complex in that the dust contains different types of particles, it may be advantageous to use a combination of these techniques to split up the individual components based on their grain size, density, etc.

It is to be noted that the recovered dust particles may constitute valuable raw materials of their own, such as kish graphite.

Finally, the separation at least in principle also yields a cleaned gas, which can or not be recycled within the method or be used to recover heat, if desirable.

The gas useable within the method will generally be (compressed) air, although inert gases, such as nitrogen, argon etc. or mixtures of one or more gases may be considered, especially if oxidation of the metal is to be prevented.

As already suggested above, in an advantageous embodiment, the method according to the invention is used prior to an active water-cooling step. Hence, the method preferably further comprises downstream of steps (a)-(c), i.e. after the cleaning and sealing of the metal surface, within in the first section of the metal casting apparatus (i.e. in a region closer to the discharge station or upper region of the first section), the step of (e) further actively cooling the superficially solidified metal from steps (a-c), respectively steps (a-d), within the casting molds by splashing or spraying water or air/water mix at least on the (exposed) surface the (superficially solidified) metal e.g. to prevent further formation of graphite particles. This step is preferably done directly downstream (i.e. immediately after) the bottomless box.

It has been found that the method of the invention is particular suitable for metal or slag casting apparatuses using active cooling with water. Indeed, starting from the problem exposed in the introduction, another solution (not according to the invention) would consist in treating or filtering the water vapors polluted with dust and graphite particles, however, this solution is expensive and difficult to apply because of the elevated temperature and humidity levels, clogging due to the moist dust or graphite particles, etc.

Moreover, the spraying or splashing with water tends not only to entrain light particles, but also particles which under normal cooling conditions would not easily be separated from the metal surface and rejected to the atmosphere. In particular, even relatively coarse or heavy particles are ejected during the sudden water evaporation when water comes into contact with the hot molten metal, thereby spreading around the plant.

By applying the method of the invention before such active cooling, not only very light particles can be removed from the molten metal surface, but even other less flyable dust particles can be removed to a significant extent (if necessary by adjusting the operation conditions of the injection and suction steps), and most importantly the surface of the metal is sealed by superficial solidification. Furthermore, the steam so produced is said to be dust free or graphite flake free following the injection of gas at the surface of the ingots. Using an appropriate device, such as a hood, this steam could even be recovered and used as such, i.e. without further cleaning, for other applications within the plant.

A further advantage of a subsequent active cooling step (e) is that it allows to prevent the previously solidified sealing layer to melt again due to the heat of the still largely molten metal inside the casting mould.

Further details of the method for reducing dust emissions in a metal casting apparatus will be explained in connection with a further aspect of the invention concerning an apparatus allowing the implementation of the above-described method.

Hence, a further aspect relates to a metal or slag casting apparatus which comprises an endless conveyor having a plurality of casting molds with upper open tops and which endless conveyor is arranged to move said casting molds in a first section from a casting station to a discharge station and in a second section back to the casting station.

According to this further aspect of the invention, the metal casting apparatus further comprises a dust control device for reducing dust emissions, the dust control device being arranged over at least part of the first section of the endless conveyor and comprises a casing forming a bottomless box having a top cover and peripheral side-walls, wherein the peripheral side-walls comprise, in the conveying direction of said casting molds in the first section, at least a front part, two lateral parts and a back part. Preferably in the top cover, there is arranged a suction opening which may be operatively connected to a gas and dust extractor. Furthermore, the dust control device comprises a plurality of blowing nozzles, each having an inlet and an outlet, wherein the outlet of each blowing nozzle is arranged within the casing, wherein the inlet of each blowing nozzle may be operatively connected to a pressurized gas supply, and wherein the outlet of each blowing nozzle is arranged in such a way that the gas stream or gas jet can efficiently remove the solid particles present at the surface of the ingots without disturbing the metal surface. The nozzles are preferentially positioned with their outlet towards the surface of the metal or slag with an angle α of 2 to 40°, preferably 3 to 30°, with respect to the upper open tops of said casting molds.

In fact, the metal casting apparatus as such (i.e. without the dust control device) may be of conventional design. The dust control device when connected to said gas supply and said gas and dust extractor allows for the implementation of the above method and thereby obtain the advantages mentioned above.

In a preferred embodiment, the inlets of the plurality of blowing nozzles are connected to one or more manifolds located outside the casing. Connecting a plurality of nozzles to a manifold dramatically reduces the number of conducts around the device and hence the space requirements, especially if the device integrates six or more nozzles. Placing the manifold(s) outside the casing greatly facilitates accessibility and maintenance of the system even during operation of the metal casting apparatus. A further advantage of such an arrangement is that only few parts are exposed to the action of any abrasive dust inside the casing.

Depending on the situation, the one or more manifolds may be individually located above the top cover, thereby allowing for a slim design wherein the dust control device does not (significantly) broaden the whole metal casting apparatus. Arranging the manifold alongside one or both lateral parts of the side-walls may be advantageous if particularly good accessibility is desired and lateral space is not an issue.

The casing is designed in such a way that it overlies at least a portion of the plurality of adjacent casting molds, generally it is dimensioned to cover 1 to 20, more preferably 2 to 12, even more preferably 4 to 8 adjacent casting molds. The device does not need to form a gas tight enclosure with the casting molds or around the conveyor to assume its function, because the dust control device comprises suction means which can be dimensioned in order that the suction rate compensates for passages of ambient air. Hence, the suction rate will be chosen such that it is greater than the gas injection rate. As a general rule, the ratio suction to injection rate (at normal conditions) is 2 to 100, preferably 10 to 80, even more preferably at least 20, at least 40 or even at least 60. In fact, the actual suction rate can be easily determined for a given equipment and a given injection rate by controlling the suction rate such that preferably at all times no gas (and of course no dust) leaks from the dust control device. In other words, the suction rate must be adapted such that the speed of the sucked ambient air at any open area is sufficient to carry/keep the dust particles within the casing, resp. the dust extraction device.

Having said this, it is however preferred that the sidewalls enclose at least the top of the conveyor in a closely contiguous manner. It seems clear that an almost gas tight enclosure is advantageous, if the gas used is not simply air, but any inert or other gas for which recovering is desirable, economical or even required.

A close fitting is also desirable for the front and the back part of the casing underneath which the filled casting molds pass when being conveyed from the casting station to the discharge station. However, sometimes when filling the casting molds, it cannot be excluded that solid chunks of partly solidified metal or slag project over the top of the casting molds. These projecting objects could however damage the casing or the entire dust control device if no precautionary measure is taken.

Hence, in a preferred aspect, the design of the apparatus takes into account the potential presence of protruding blocks that may damage the system. One solution could be to detect the presence of any protruding object and to remove it before the dust control device, either in-line or by stopping the conveyor. However, while the first cannot always be done, the latter is of course economically not desirable.

Another solution is to envisage means enabling the safe passage of such protruding objects, such as by providing in each of front and back parts of the peripheral sidewalls a gate-like structure, which can swing, tilt or retract itself to let pass the protruding object without risk to damage the device.

Hence, in order to prevent damages to the dust control device by objects protruding from the molds, the front and the back part of peripheral side-walls each comprise a gate, preferably a swinging rigid gate or flexible lid made of heat resistant material, a chain curtain, etc.

The blowing nozzle(s) is/are preferably arranged such that essentially the whole surface of the ingots within the dust control device is covered by the gas jet(s). To further improve the efficiency of the system, it may be advantageous to direct the nozzle(s) located in proximity of the front and/or the back, with a slight angle directed towards the center of the casing and/or the suction opening. This arrangement prevents blown-off particles from leaving the casing by the front or back part/door. Hence, in a further embodiment, the outlet of at least part of blowing nozzles is arranged such as to cover the whole surface of the molds, preferably by orienting some of the nozzle(s) to form an angle β of 4 to 45°, preferably 5 to 40°, with respect to a direction perpendicular to the conveying direction of the casting molds.

As already mentioned above in relation with the method, the apparatus preferably also further comprises an active cooling station in the first section between said dust control device and said discharge station, the active cooling station comprising water or water/air splashing or spraying nozzles arranged above said casting molds.

Likewise, the suction opening is preferably connected to a gas and dust extractor and the dust extractor comprising one or more dust separators selected from bag filters, electrostatic filters, cyclones, scrubber, etc.

In a still further aspect, the invention concerns the use of a dust control device as described herein for reducing dust emission in metal casting, in particular in metal casting apparatuses with endless conveyor.

BRIEF DESCRIPTION OF THE DRAWINGS

A preferred embodiment of the invention will now be described, by way of example, with reference to the accompanying drawings in which.

Further details and advantages of the present invention will be apparent from the following detailed description of several not limiting embodiments with reference to the attached drawings.

DETAILED DESCRIPTION

Figure 1:
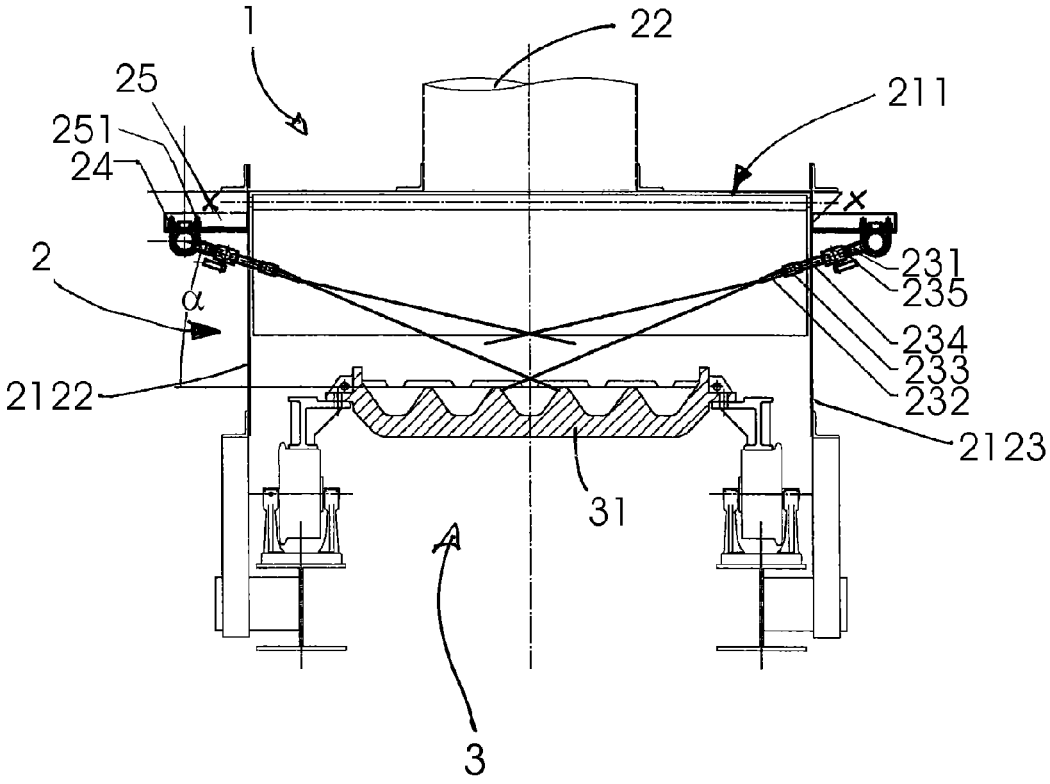
FIG. 1 is a cross sectional view of an embodiment of a metal casting apparatus in the first section through a dust control device.
Figure 2:
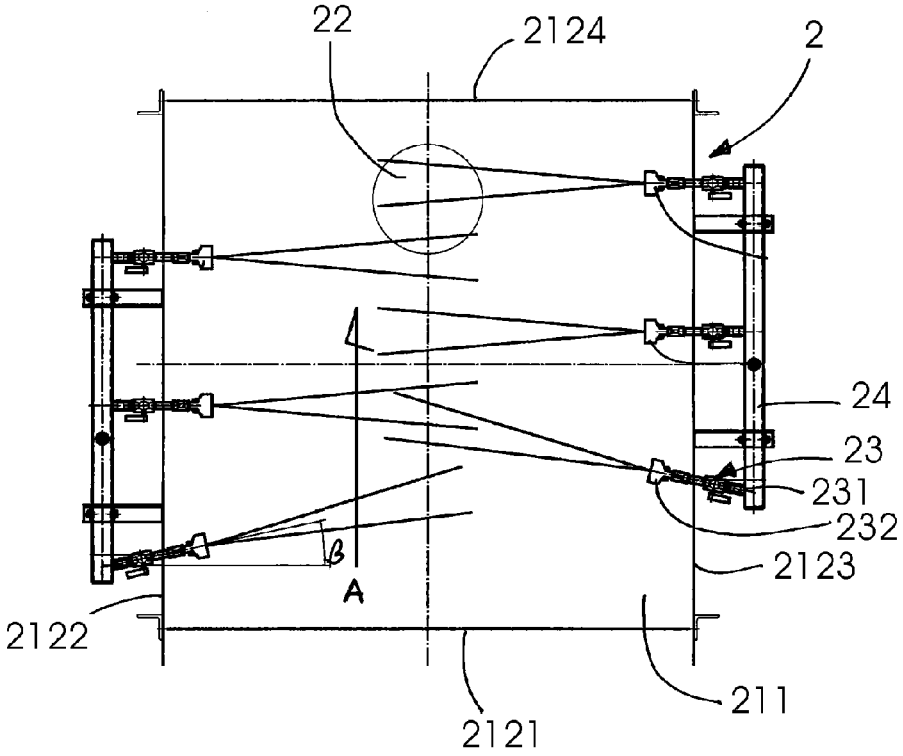
FIG. 2 is a top view (with top cover and conveyor not shown) of an embodiment of the dust control device shown in FIG. 1.

FIG. 1 shows a cross sectional view of a preferred embodiment of a metal or slag casting apparatus 1. The cross section represented by FIG. 1 is located in the first section of the endless conveyor 3 between the casting station (not shown) to the discharge station (not shown). FIG. 2 corresponds to a top view of section X-X in FIG. 1, but of the dust control device only (conveyor not shown).

In this first section, above the endless conveyor 3 having a plurality of casting molds 31, a dust control device 2 having a casing comprising a top cover 211 and peripheral sidewalls is provided. The peripheral sidewalls comprise, relative to the conveying direction A (see FIG. 2), a front part 2121, two lateral parts 2122, 2123 and a back part 2124.

A plurality of blowing nozzles 23 (of which two are shown in FIG. 1) are arranged such that their outlets 232 are located within the casing 2 at an angle α with respect to the top of the casting molds 31. The outlet 232 of the nozzle is connected via reduction sleeve 233, tubular section 234 and nipple 235 to the inlet 231. The inlet 231 is fixed to manifold 24 which is connectable to a compressed gas supply (not shown).

The manifold 24 is attached with U clamps 251 to the support 25. In the embodiment shown the supports 25 for the manifolds 24 are attached to the lateral parts 2122 and 2123 of the casing.

A suction opening 22 is provided in the top cover 211, which opening is connectable to gas and dust extractor (not shown). This gas and dust extractor preferably comprises one or more bag filters, electrostatic filters, cyclones and scrubbers depending on the nature of the dust and one or more extraction fans. In the embodiment of FIGS. 1 and 2, the suction opening is located at a central top position in the top cover. However, a plurality of suction openings could be provided, e.g. one on each side in the top cover to particularly pick up the dust particles blown off by the opposing nozzles. In such a case the different openings could be connected to the gas and dust extractor through a collector. If blowing nozzles are provided on one side only of the dust control device, the suction opening is preferably located on the opposite side in the top cover.

As can be seen in FIG. 2, some of the nozzles 23 located near the front part 2121 of casing are oriented towards the middle of the casing, resp. towards the suction opening 22 with an angle β with respect to a direction perpendicular to conveying direction A.

Furthermore, blowing nozzles 23 on opposing lateral sides 2122 and 2123 are preferably arranged with a relative offset to obtain optimum results.

The invention claimed is:

1. A method for reducing dust emissions in a metal or slag casting apparatus comprising an endless conveyor having a plurality of casting molds with upper open tops and which endless conveyor is arranged to move said casting molds in a first section from a casting station to a discharge station and in a second section back to the casting station, wherein the method comprises the steps of (a) providing a casing forming a bottomless box over a part of the first section of the endless conveyor located adjacent to the casting station, (b) injecting within said casing a gas on a surface of the casting mold with an angle α configured to blow off loose, solid particles, formed at the surface of a metal, during early stages of cooling down and to start solidification of a superficial layer of metal or slag, (c) extracting the gas and the solid particles by suction from within said casing.

2. The method as claimed in claim 1, further comprising the step of (d) separating the solid particles from the gas.

3. The method as claimed in claim 1, further comprising downstream of step (c)

an active cooling step of the superficially solidified metal by splashing or spraying water or air/water mix at least on the surface of the metal.

4. The method as claimed in claim 3, wherein the injecting step is effected directly after the bottomless box.

5. The method as claimed in claim 1, wherein the angle α is between 2 to 40° with respect to the upper open tops of casting molds containing molten metal or slag.

6. The method as claimed in claim 1, wherein said loose, solid particles comprise graphite flakes.

7. The method as claimed in claim 6, further comprising downstream of step (c)

an active cooling step of the superficially solidified metal by splashing or spraying water or air/water mix at least on the surface of the metal.

8. The method as claimed in claim 7, wherein the injecting step is effected directly after the bottomless box.

9. The method as claimed in claim 1, further comprising the step of separating the solid particles from the gas using bag filters, electrostatic filters, cyclones, or scrubbers.

10. A metal or slag casting apparatus comprising an endless conveyor having a plurality of casting molds with upper open tops and which endless conveyor is arranged to move said casting molds in a first section from a casting station to a discharge station and in a second section back to the casting station, a dust control device for reducing dust emissions, the dust control device comprising a casing forming a bottomless box over a part of the first section of the endless conveyor located adjacent to the casting station, said casing having a top cover and peripheral sidewalls, wherein the peripheral sidewalls comprise, in the conveying direction of said casting molds in the first section, at least a front part, two lateral parts and a back part, a suction opening arranged in the top cover, the suction opening being operatively connectable to a gas and dust extractor, a plurality of blowing nozzles, each having an inlet and an outlet, wherein the outlet of each blowing nozzle is arranged within the casing, wherein the inlet of each blowing nozzle is operatively connectable to a pressurized gas supply, wherein the outlet of each blowing nozzle is arranged with an angle α with respect to the upper open tops of casting molds, said angle α being configured to blow off loose, solid particles formed at the surface of a metal, during early stages of cooling down and to start solidification of a superficial layer of metal or slag.

11. The apparatus as claimed in claim 10, wherein the angle α is between 2 to 40° with respect to upper open tops of the casting molds containing molten metal or slag.

12. The apparatus as claimed in claim 10, wherein the inlets of the plurality of blowing nozzles are connected to one or more manifolds located outside the casing.

13. The apparatus as claimed in claim 12, wherein the manifold(s) is/are located above the top cover or alongside the lateral part(s) of the sidewalls.

14. The apparatus as claimed in claim 10, wherein the outlet of at least part of blowing nozzles is arranged such that the whole surface of the ingots is covered by the gas jet.

15. The apparatus as claimed in claim 14, wherein the outlet of said at least part of the nozzles is positioned at an angle β of 4 to 45° with respect to a direction perpendicular to the conveying direction of said casting molds.

16. The apparatus as claimed in claim 10, wherein the casing of the dust control device is dimensioned to cover 2 to 12 adjacent casting molds.

17. The apparatus as claimed in claim 10, wherein the front and the back part of peripheral side-walls each comprise a gate.

18. The apparatus as claimed in claim 10, further comprising an active cooling station in the first section between said dust control device and said discharge station, the active cooling station comprising water or air/water splashing or spraying system arranged above said casting molds.

19. The apparatus as claimed in claim 10, wherein the suction opening is connected to a gas and dust extractor and the gas and dust extractor comprises one or more dust separators selected from bag filters, electrostatic filters, cyclones, and scrubbers.

20. The apparatus as claimed in claim 10, further comprising an active cooling station in the first section between said dust control device and said discharge station, the active cooling station comprising water or air/water splashing or spraying system arranged above said casting molds, immediately after the dust control device.

* * * * *